US005984098A

United States Patent [19]

Cahen et al.

[11] Patent Number: 5,984,098

[45] Date of Patent: Nov. 16, 1999

[54] SURPRISE BOX FOR CONTAINING OBJECTS

[75] Inventors: Philippe Cahen, Paris; Mathias D'Estais, Vincennes, both of France

[73] Assignees: Sarl "Optos-Opus", Paris; Capital Innovation, Saint Ouen, both of France

[21] Appl. No.: 09/130,450

[22] Filed: Aug. 7, 1998

[30] Foreign Application Priority Data

Jul. 15, 1998 [FR] France ..... 98-09039

[51] Int. Cl.[6] ..... B65D 73/00

[52] U.S. Cl. ..... 206/457; 446/73; 446/76

[58] Field of Search ..... 206/457, 6.1, 523, 206/575; 273/139; 446/404, 76, 73

[56] References Cited

U.S. PATENT DOCUMENTS

| | | | |
|---|---|---|---|
| 4,200,197 | 4/1980 | Meyer et al. | 446/76 |
| 4,593,817 | 6/1986 | Ferrero . | |
| 4,715,840 | 12/1987 | Swift | 446/73 |
| 5,044,959 | 9/1991 | Shaver et al. | 446/76 |
| 5,282,766 | 2/1994 | Fleet . | |
| 5,285,898 | 2/1994 | Zinbarg et al. | 206/457 |
| 5,389,028 | 2/1995 | Cabrera et al. | 446/73 |
| 5,525,088 | 6/1996 | Mayne . | |
| 5,551,569 | 9/1996 | Garvin-mazzarisi | 206/457 |
| 5,632,377 | 5/1997 | Ferrero . | |
| 5,797,507 | 8/1998 | Kramer . | |

FOREIGN PATENT DOCUMENTS

| | | |
|---|---|---|
| 905 472 | 1/1987 | Belgium . |
| WO 90 14141 | 11/1990 | WIPO . |

OTHER PUBLICATIONS

Copy of International Search Report dated Oct. 16, 1998.

*Primary Examiner*—Paul T. Sewell
*Assistant Examiner*—Luan K. Bui
*Attorney, Agent, or Firm*—Sixbey, Friedman, Leedom & Ferguson, P.C.; Stuart J. Friedman

[57] ABSTRACT

The invention relates to a surprise box for containing objects. According to the invention, the surprise box is essentially constituted by a hollow body made of deformable material, provided with an opening zone giving access to the inside of the hollow body by deforming the wall of said hollow body adjacent to said opening zone, effaceable obstacles also being provided inside the hollow body to complicate searching for and taking hold of objects disposed inside said surprise box.

10 Claims, 3 Drawing Sheets

SURPRISE BOX FOR CONTAINING OBJECTS

FIELD OF THE INVENTION

The present invention relates to a surprise box for containing objects. The objects concerned may be candies or sweets of any kind, or playthings, or indeed novelty jewelry, or more generally any type of attractive object that is suitable for motivating a certain amount of effort in searching for and taking hold of it inside the surprise box.

The term "box" is used herein in a broad sense, covering any type of container without restriction to any particular form, and in particular without restriction to any particular geometrical shape.

BACKGROUND OF THE INVENTION

Numerous boxes are already known constituted by a rigid shell, e.g. having the shape of an animal or an egg, of the kind which objects such as miniature toys or candies are hidden or stored. Reference can be made for example to documents U.S. Pat. No. 5,632,377, U.S. Pat. No. 5,282,766, and U.S. Pat. No. 4,593,817.

More recently, proposals have been made for a toy of flexible structure, e.g. in the form of a silo or a house, having spaces accessible via slots, or via openings closed by flexible flaps, in which spaces various objects can be inserted for storage, such as toys or CDs (see for example document U.S. Pat. No. 5,525,088).

Nevertheless, the approach of that type of toy remains limited to a box having storage spaces for objects, without there being any surprise effect for a child seeking to recover the object(s) stored in such spaces. The spaces therefore constitute no more than pigeon-holes or compartments in a storage assembly.

OBJECTS AND SUMMARY OF THE INVENTION

An object of the invention is to provide a surprise box for containing objects, in which the design of the box amuses and/or excites people (not necessarily children) seeking to recover the objects stored therein.

According to the invention, this problem is solved by a surprise box for containing objects, constituted by a hollow body made of deformable material, provided with an opening zone giving access to the inside of the hollow body by deforming the wall of said hollow body adjacent to said opening zone, effaceable obstacles also being provided inside the hollow body to complicate searching for and taking hold of objects disposed inside said surprise box.

Thus, when a person desires to recover one or more objects which are placed inside the surprise box, the person must pass a hand through the opening zone of the hollow body and search for the objects placed therein relying solely on the sense of touch, with the acts of searching for the objects and of taking hold of them being deliberately complicated by the presence of the effaceable obstacles.

Preferably, the opening zone is constituted by a narrow slot, optionally having sides that touch. In practice, the narrow slot is of a size to allow close-fitting passage of one hand. By using this size, it is certain that the person can easily pass a hand into the narrow opening slot, but without being able to look inside the interior space of the hollow body constituting the surprise box, and thus without being able to see the objects that are to be taken.

In a particular embodiment, the narrow slot may have a crenellated edge. By way of example, this type of edge can represent a mouth with teeth, thus producing a particular effect for the surprise box. A person seeking to recover objects placed inside the surprise box thus has the impression of putting a hand in the mouth of an animal or of some evocative object.

In a first embodiment, at least some of the effaceable obstacles are secured to the inside wall of the hollow body. In particular, the effaceable obstacles may project from the inside wall, e.g. forming stalagmites, stalactites, or bulbs.

In a variant embodiment, at least some of the effaceable obstacles are recesses in the inside wall, e.g. forming cavities.

In yet another variant, it is possible to provide for at least some of the effaceable obstacles to be independent solids such as balls, polyhedra, or the like.

Naturally, it is possible to provide a surprise box in which the hollow body is fitted internally with several types of effaceable obstacle simultaneously.

It is also advantageous to provide for the hollow body and the effaceable obstacles to be made out of the same soft material such as foam or gelatin.

Also preferably, the hollow body has a novelty shape, preferably an evocative shape. In particular, provision can be made for the hollow body to have the form of a pumpkin, and the opening zone to have the form of a cutout mouth, or in a variant for the hollow body to have the form of an animal, and the opening zone to correspond to the mouth of the animal.

Finally, it is possible to provide for the surprise box to be fitted with cordless electronic means capable of generating sound signals and/or light signals.

BRIEF DESCRIPTION OF THE DRAWINGS

Other characteristics and advantages of the invention appear more clearly in the light of the following description relating to a particular embodiment, given with reference to the figures of the accompanying drawings, in which.

MORE DETAILED DESCRIPTION

Figure 1:
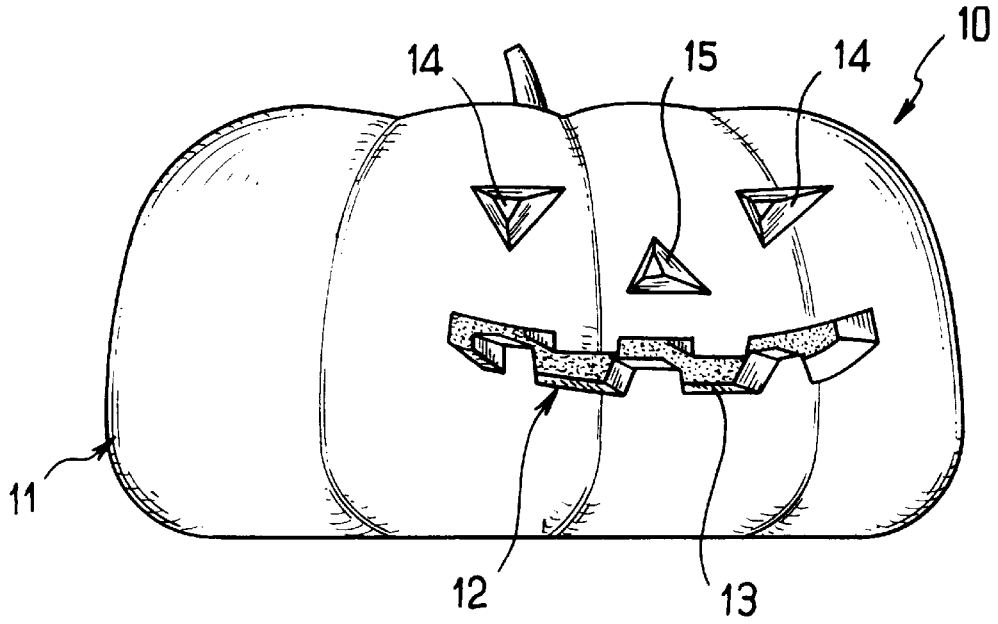
FIG. 1 is a perspective view of a surprise box of the invention in which the hollow body is implemented in the form of a pumpkin evocative of the lanterns used for Halloween.
Figure 2:
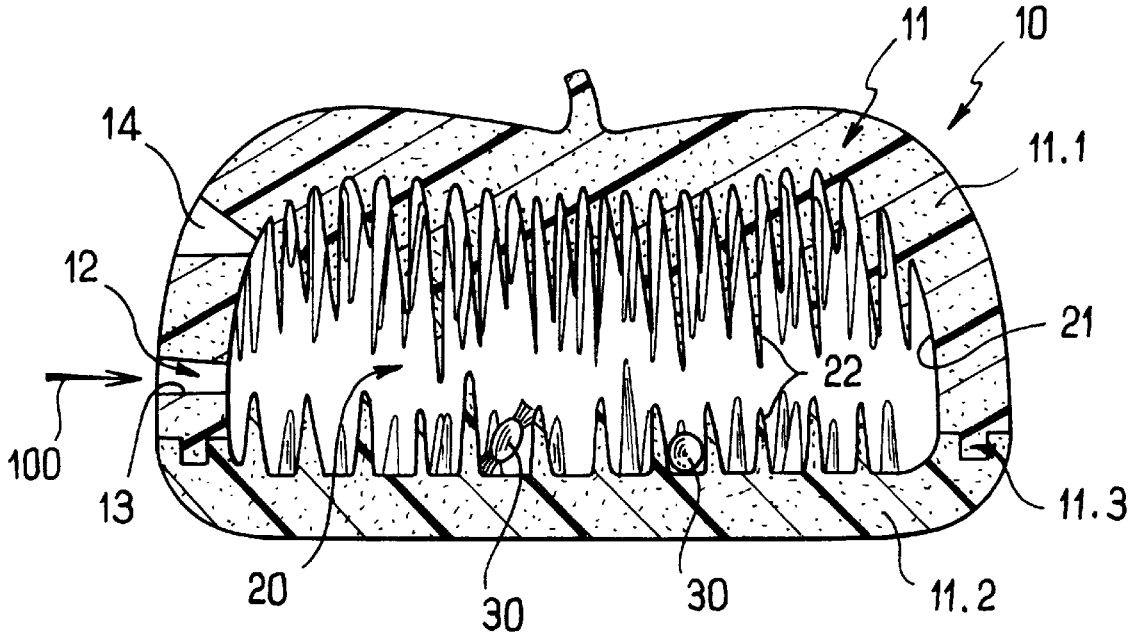
FIG. 2 is a cross-section on a diametral plane passing through one of the eyes and the mouth represented in the hollow body of FIG. 1, and serves to show the inside space of the hollow body which in this case has projecting effaceable obstacles, and two objects to be recovered.
Figure 3:
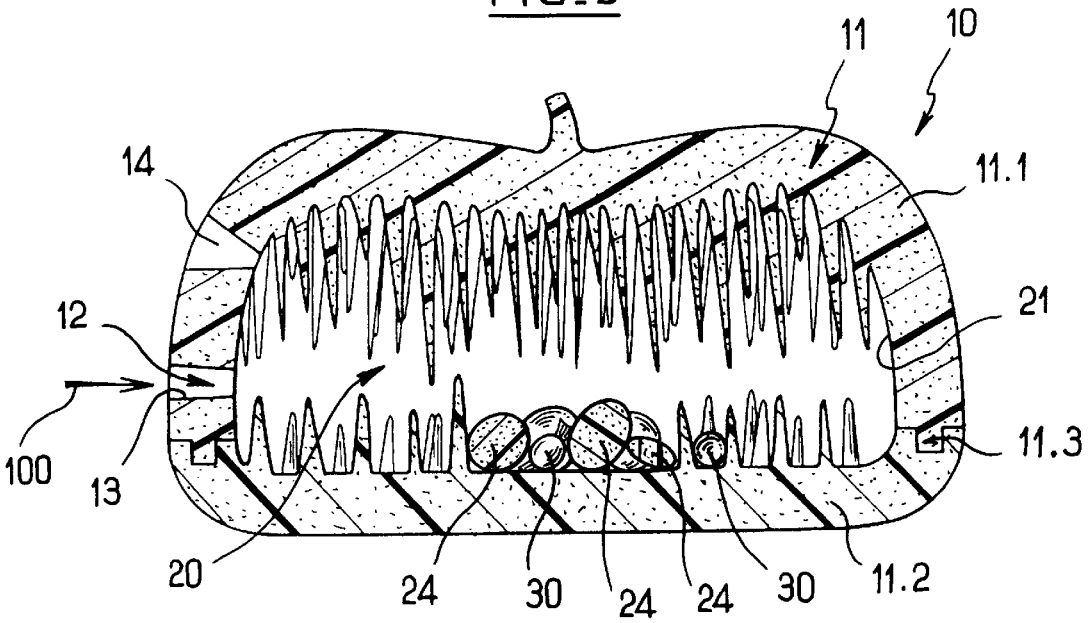
FIG. 3 is a section analogous to that of FIG. 2, showing another variant in which some of the effaceable obstacles are constituted by independent solids which are preferably made of the same material as that constituting the hollow body.
Figure 4:
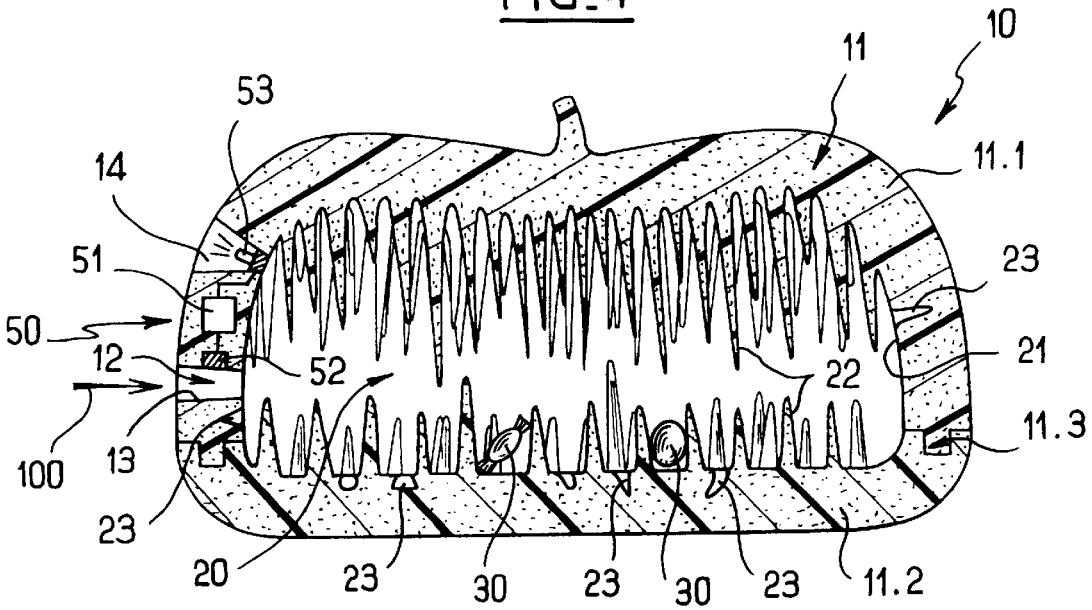
FIG. 4 is another section view analogous to the preceding section views, showing a hollow body fitted with cordless electronic means capable of generating sound and/or light signals.
Figure 6:
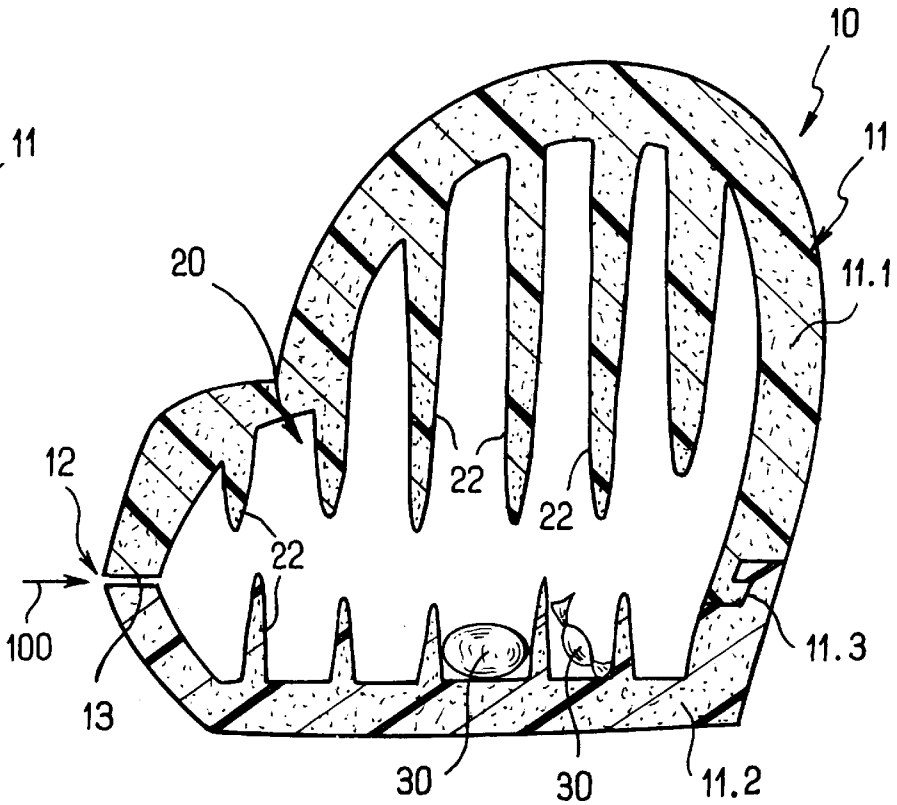
FIG. 6 is a cross-section on a vertical plane passing through the nose and between the eyes of the hollow body of FIG. 5.
Figure 5:
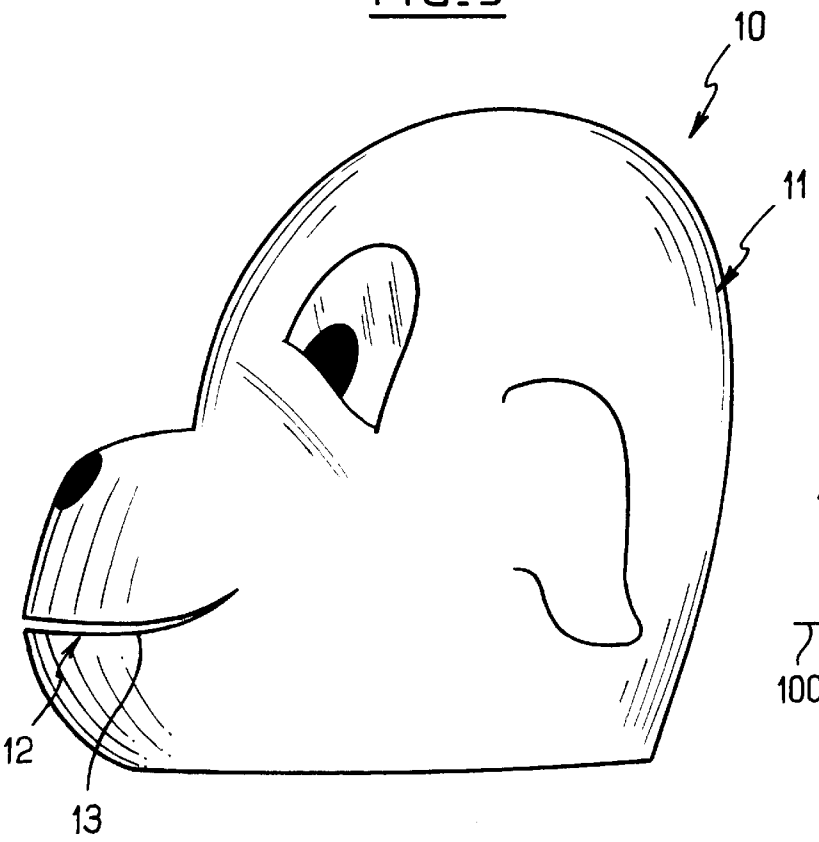
FIG. 5 is a perspective view of a surprise box of the invention in which the hollow body is implemented in the form of an animal.

In FIG. 1, there can be seen a surprise box 10 designed to contain objects (not visible in this figure), which objects can be seen in sections of FIGS. 2 to 4, e.g. in the form of a candy, a toy, or a piece of novelty jewelry, said objects being referenced 30. Naturally the invention is not limited in any way to one particular type of object.

The surprise box 10 is essentially constituted by a hollow body 11 that is made of deformable material, being provided with an opening zone 12 giving access to the inside of the hollow body by deforming said hollow body adjacent to said opening zone. In FIG. 1, the hollow body 1 is in the shape of a pumpkin, and the opening zone 12 forms a cutout mouth, being constituted by a narrow slot 13 having a crenellated edge in this case. The narrow slot 13 could naturally have edges that touch each other, and in practice is of a dimension suitable for allowing close-fitting passage of one hand. The pumpkin-shaped hollow body 11 may also have openings 14 symbolizing eyes and an opening 15 symbolizing a nose, in the manner commonly used for making lanterns for Halloween festivities. In this case, the openings 14 and 15 are shaped so as to prevent access to the inside space of the hollow body, said access being via the narrow slot 13.

When a person seeks to recover an object placed inside the surprise box, it is necessary to pass a hand through the opening zone 12, passing through the narrow slot 13 which fits closely over the hand, so that the person cannot see into the inside space of the hollow body 11, and in particular cannot see the objects 13 to be recovered.

In accordance with another characteristic of the surprise box of the invention, and as visible in the sections of FIGS. 2 to 4, effaceable obstacles are also provided inside the hollow body 11 to complicate searching for and taking hold of objects 30 disposed inside the surprise box 10.

In FIG. 2, reference 20 designates the inside space of the hollow body 11, and it can be seen that the inside wall 21 of the hollow body 11 has projecting elements referenced 22 constituting the above-mentioned effaceable obstacles, in this case forming stalagmites and stalactites which are soft and deformable. These effaceable obstacles 22 are provided to make seeking for and taking hold of the objects 30 more complicated when a person passes a hand through the slot 13 so as to be guided solely by the sense of touch when trying to recover the objects 30. Naturally, the shapes of the stalagmites and stalactites shown in FIG. 2 are shown by way of example only, and any type of projecting relief could be provided, such as bulbs or otherwise.

Arrow 100 represents the hand (not shown) passing through the narrow slot 13 for the purpose of recovering one or more of the objects 30 placed inside the surprise box 10.

The hollow body 11 and the effaceable obstacles 22 are preferably made out of the same soft material, such as foam or gelatin. In particular, it is possible to use recently-developed materials that are highly deformable, and that present a surface that is more or less gooey, giving them a peculiar feel. Optionally, the material used can include aromas embedded therein so that it also has a particular odor.

FIG. 2 shows a hollow body made of foam, and constituted in this case by assembling together two half-shells 11.1 and 11.2 which meet in a join plane 11.3. Nevertheless, that is merely one possible embodiment, and any other manufacturing technique could be used, by molding or otherwise, that enables a hollow body 11 of the above-specified to be obtained.

The variant shown in FIG. 3 differs from the preceding variant only by the fact that at least some of the effaceable obstacles are constituted by independent solids, such as balls, polyhedra, or the like for example. Thus, in FIG. 3, there can be seen several balls referenced 24, located in this case in the central zone of the inside space of the hollow body 11, these solid bodies being preferably made out of foam or of gelatin, and using the same material as that used to make the hollow body 11. The presence of independent solid bodies 24 makes searching for the objects 30 even more complicated, and further excites the person trying to take hold of the desired objects in the fingers.

The variant shown in FIG. 4 shows further types of effaceable obstacle that can be used together with the above-mentioned projecting obstacles 22, these obstacles being implemented as recesses relative to the inside wall 21. Thus, there are effaceable obstacles 23 in the form of cavities. In this case, the fingers of the person trying to recover an object 30 placed inside the surprise box 10 encounter obstacles into which they penetrate, thus making searching and taking the desired obstacles even more exciting.

The diagram of FIG. 4 also shows optional equipment that can be used with the surprise box 10 of the invention.

This equipment comprises cordless electronic means referenced 50 capable of generating sound signals and/or light signals. A miniature control box referenced 51 is shown diagrammatically, which is fitted with its own power supply such as a battery or the like, and which is capable of controlling firstly the emission of a sound signal, e.g. by means of a detector 52 disposed at the narrow slot 13 so that passing a hand through said slot automatically causes a sound signal to be emitted. Secondly, the device 51 can also cause light signals to be generated, by switching on lighting members such as light emitting diodes (LEDs): for example a lighting member could be provided such as the member shown at 53 in each of the eyes of the pumpkin, i.e. in the cutout openings 14. The light signal may possibly be flashing. It is also possible to provide a time delay to restrict the time that can be spent searching: for example, after 15 seconds of searching for the described objects, the sound signal may change suddenly into a more impressive noise, and the frequency at which the lighting members flash can also accelerate.

The illustrations show a hollow body 11 in the form of a pumpkin, however, it is naturally possible for any other type of novelty shaped hollow body to be provided, preferably of an evocative shape. For example, the hollow body may be in the form of an animal, with the opening zone 12 then corresponding in general to the mouth of the animal. It would thus be possible to provide a body in the form of an octopus, a wolf, a monster, etc. which is accessed via the mouth, or in a variant via an incision made in the belly of the animal. It would also be possible to provide a form corresponding to any kind of plant, for example a carnivorous plant, a mushroom, etc. More generally, other evocative novelty shapes include a haunted castle, a skull, a football, a globe, etc.

The invention is not limited to the embodiments described above, but on the contrary covers any variant using equivalent means to reproduce the essential characteristics specified above.

In particular, the hollow body could be made using an elastomer skin of the kind used for making masks that adhere to the skin.

Similarly, the hollow body could be provided with a plurality of narrow slot opening zones through which a hand can be slid, thereby making it possible to make the surprise box into a plaything, for example, where several people can search simultaneously for the desired object. It is also possible to organize the hollow body in the form of a monster having multiple heads, each of which provides an access slot.

We claim:

1. A surprise box for containing objects, wherein the box is essentially constituted by a hollow body made of deformable material, provided with a narrow slot giving access to the inside of the hollow body by deforming a wall of said hollow body adjacent to said narrow slot, and wherein a plurality of elongate portions is also provided inside the hollow body, said portions being integral with and projecting from an inside wall of said hollow body and being elastically deflectable when a hand is passed through said narrow slot for searching and taking objects disposed inside said surprise box, said hollow body and said elastically deflectable elongate portions being made out of the same soft material, said material being selected from the group consisting of foam and gelatin.

2. A surprise box according to claim 1, wherein the narrow slot is of a size to allow close-fitting passage of one hand.

3. A surprise box according to claim 1, wherein the narrow slot has a crenellated edge.

4. A surprise box according to claim 1, wherein the elastically deflectable elongate portions that project from the inside wall are selected from the group consisting of stalagmites, stalactites, and bulbs.

5. A surprise box according to claim 1, wherein recesses in the inside wall of said hollow body are also provided among some of the elastically deflectable elongate portions.

6. A surprise box according to claim 1, wherein independent solids are also provided inside the hollow body between some of the elastically deflectable elongate portions.

7. A surprise box according to claim 1, wherein the hollow body is in the form of a pumpkin, and the narrow slot is in the form of a cutout mouth.

8. A surprise box according to claim 1, wherein the hollow body is in the form of at least a part of an animal, and the narrow slot corresponds to the mouth of the animal.

9. A surprise box according to claim 1, fitted with cordless electronic means capable of generating sound signals.

10. A surprise box according to claim 1, fitted with cordless electronic means capable of generating light signals which are visible on the outside of said box.

* * * * *